US005658186A

United States Patent [19]

Perrotto et al.

[11] Patent Number: 5,658,186

[45] Date of Patent: Aug. 19, 1997

[54] JIG FOR POLISHING THE EDGE OF A THIN SOLID STATE ARRAY PANEL

[75] Inventors: Joseph A. Perrotto, Landenberg, Pa.; Emil J. C. Hergenroeder, Jr., Baltimore, Md.; Robert S. Davis, Hatboro, Pa.

[73] Assignee: Sterling Diagnostic Imaging, Inc., Newark, Del.

[21] Appl. No.: 680,952

[22] Filed: Jul. 16, 1996

[51] Int. Cl.[6] ..... B24B 1/00

[52] U.S. Cl. ..... 451/41; 451/44

[58] Field of Search ..... 451/41, 42, 43, 451/44, 255, 256, 285, 384, 278, 282, 367, 369, 390, 283

[56] References Cited

U.S. PATENT DOCUMENTS

| | | | |
|---|---|---|---|
| 5,313,066 | 5/1994 | Lee et al. | 250/370.09 |
| 5,351,445 | 10/1994 | Takahashi | 451/271 |
| 5,381,014 | 1/1995 | Jeromin et al. | 250/370.09 |

OTHER PUBLICATIONS

Manual for the Operation and Maintneance of The PP5 Precision Polishing Jig: Ref. No. BE-01-7-2; Logitech Inc. Nashua, NH 03063.

Foldout-PP5GT Jig Cut-away; p. 18; Paragraphs 1.1 to 1.2.3; and FIGS. 4, 5, & 8.

*Primary Examiner*—James G. Smith
*Assistant Examiner*—Derris H. Banks
*Attorney, Agent, or Firm*—Ratner & Prestia

[57] ABSTRACT

A jig for polishing a end of a thin solid state imaging panel on a horizontal rotating polishing surface is composed of a supporting ring structure, a panel holder and a panel mount. The supporting ring structure is composed of a supporting ring with a polished bottom surface and two slide guides extending vertically from the top of the ring. The panel holder is composed of two slide bearings adapted to accept the two slide guides on the supporting ring and a planar mounting surface. The panel holder is mounted on the supporting ring structure so that the slide guides and the slide bearings co-operate to support the panel holder on the ring in a plane perpendicular to the rotating polishing surface to permit the panel holder to move linearly under gravity in a vertical direction from a raised position where a polished bottom end of the panel holder is not in contact with the polishing surface, to a second position where the bottom end is in contact with the polishing surface. The panel mount secures the panel to the panel holder during the polishing operation. In operation, a solid state imaging panel is rigidly mounted to the panel holder in such a way that the panel protrudes down from the panel holder a preset distance. This panel holder is mounted on the ring structure of the polishing jig and the jig is placed on the surface of the rotating polishing wheel. As the glass is polished, the protruding panel and panel holder slowly lower by gravity to maintain contact with the polishing wheel surface. When the protruding section of the panel has been polished even with the polished bottom end of the panel holder, the polishing rate slows significantly and the process is complete.

14 Claims, 4 Drawing Sheets

JIG FOR POLISHING THE EDGE OF A THIN SOLID STATE ARRAY PANEL

BACKGROUND OF THE INVENTION

The present invention relates to a jig for polishing the edge or end of thin glass panels. More particularly, this invention relates to a jig for polishing the end of thin solid state array panels with high accuracy with respect to features on the panel.

DESCRIPTION OF RELATED ART

There is a need for large area (14×17 inches) flat panel solid state imaging devices for use in direct radiography. Flat panel solid state imaging devices contain an array of thin film transistor (TFT) pixels on a thin glass substrate such as the conversion element disclosed in Lee et al., U.S. Pat. No. 5,313,066. However, current state of the art limits the ability to manufacture such panels to approximately 8×10 inches. Thus, to achieve the required imaging area, it is necessary to build up a large panel out of several smaller ones. This process, called "tiling", requires that individual tiles fit very accurately with one another leaving gaps of less than 10 microns. Also, it is important that the pixel to pixel spacing within each panel be carried across the tile joint. For the current TFT panels with a pixel pitch of 139 microns, the end of the glass substrate must be within 5 microns of the pixel across the entire end.

Existing end cutting techniques, such as dicing or scribing, can accurately cut an end, but they produce large chips (20–50 microns) that would damage the pixels. Polishing gives a chip free end but is difficult to control. There are existing polishing fixtures, such as PP-5, that allow for edge polishing of thin glass. However, these fixtures are limited to panels approximately 2×2 inches and do not provide for adequate precision required for edge polishing of 8×10 inches TFT panels. Accordingly, there is a need for a polishing fixture that can provide for the precision edge polishing of TFT panels having ends about 8 inches or greater.

SUMMARY OF THE INVENTION

This need is met by the polishing jig of this invention which is a jig for polishing a end of a panel having a front and a back surface and a top and a bottom end, for use with a polishing apparatus comprising a substantially horizontal rotating polishing surface and a supporting ring resting on said rotating surface, wherein:

a) the supporting ring comprises two slide guides extending vertically from said ring;

b) a panel holder mounted on the supporting ring and comprising a top and a bottom, said holder including two slide bearings adapted to accept the two slide guides on said supporting ring, the slide guides and the slide bearings co-operating to support the panel holder on said ring in a plane substantially perpendicular to the horizontal rotating polishing surface and to permit the panel holder to move linearly under gravity in a vertical direction from a first position where the panel holder bottom end is not in contact with said horizontal rotating surface to a second position where the panel holder bottom end is in contact with said horizontal rotating surface, the panel holder having a planar mounting surface; and c) a panel mount for securing the panel onto the panel holder.

In preferred embodiments of this invention, the planar mounting surface of the jig is substantially perpendicular to the horizontal rotating polishing surface; the panel holder bottom end is a polished reference surface; and the panel holder further comprises a micrometer adjustable panel stop located near said panel holder top end.

Another embodiment of this invention is a process for polishing an end of a panel using a jig for use with a polishing apparatus comprising a substantially horizontal rotating polishing surface and a supporting ring resting on said rotating surface, wherein:

a) the supporting ring comprises two slide guides extending vertically from said ring;

b) a panel holder mounted on the supporting ring and comprising a top and a bottom, said holder including two slide bearings adapted to accept the two slide guides on said supporting ring, the guides and the slide bearings co-operating to support the panel holder on said ring in a plane substantially perpendicular to the horizontal rotating polishing surface and to permit the panel holder to move linearly under gravity in a vertical direction from a first position where the panel holder bottom end is not in contact with said horizontal rotating surface to a second position where the panel holder bottom end is in contact with said horizontal rotating surface, the panel holder having a planar mounting surface; and c) an panel mount for securing the panel onto the panel holder; the panel having a front and a back surface, and a top and a bottom end, and an array of a plurality of solid state electronic pixels adjacent the front surface and parallel to at least the bottom end; the process comprising:

I. mounting the back surface of the panel onto the planar mounting surface of the panel holder wherein the bottom end of the panel is juxtaposed to the panel holder bottom end;

II. adjusting the panel on the panel holder to position the array a specified distance from the panel holder bottom end wherein a portion of the bottom end of the panel extends beyond the specified distance and the panel holder bottom end;

III. securing the panel onto panel holder with the panel mount;

IV. placing the polishing jig with the panel mounted thereon onto the horizontal rotating polishing surface and polishing the bottom end to remove the portion of the bottom end which extends beyond the panel holder bottom end.

BRIEF DESCRIPTION OF THE DRAWINGS

The invention can be more fully understood from the following description thereof in connection with the accompanying drawings described as follows.

DETAILED DESCRIPTION OF THE INVENTION

Figure 4:
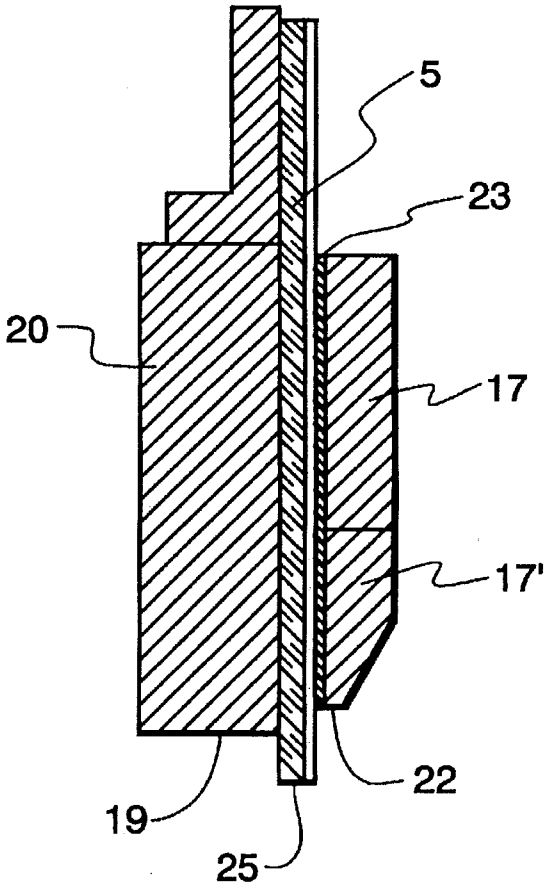
FIG. 4 is an enlarged schematic cross-sectional representation of the assembled mounting plate, TFT panel, and panel mount taken from area z in FIG. 2.

In order to produce a large imaging panel for direct radiography such as for chest x-ray imaging, typically four solid state array panels, i.e., TFT array panels, are assembled together. A TFT array panel typically comprises an 7.25×8.6×0.043 inches planar dielectric support, such as glass, having an array of solid state electronic pixels adjacent the top surface with a precise separation between pixels. The need to maintain the precise separation across the joint of the panel tiles requires that each of the TFT arrays have two ends that are polished flat and within a specified distance (e.g., 5 microns or less) of the array pixels, so that they mate with adjacent arrays to provide the precise separation. The polishing jig of this invention allows for precise control (within 1 micron) of the end to pixel placement of the TFT arrays. In the process of this invention the TFT panel is rigidly mounted to a stainless steel panel holder of the polishing jig in such a way that the panel protrudes down from the panel holder a preset distance. This panel holder is mounted on slide bearings that allow it to move vertically on journal posts attached to a steel ring. This ring rides on top of a large diameter flat polishing wheel. As the glass is polished, the glass and block slowly lowers by gravity to maintain contact with the polishing wheel surface. When the glass has been polished even with the block the polishing rate slows significantly and the process is complete. Throughout the following detailed description, similar reference characters refer to similar elements in all figures of the drawings. The figures of the drawings are representations drawn to illustrate the process of this invention and are not drawn to scale.

Figure 1:
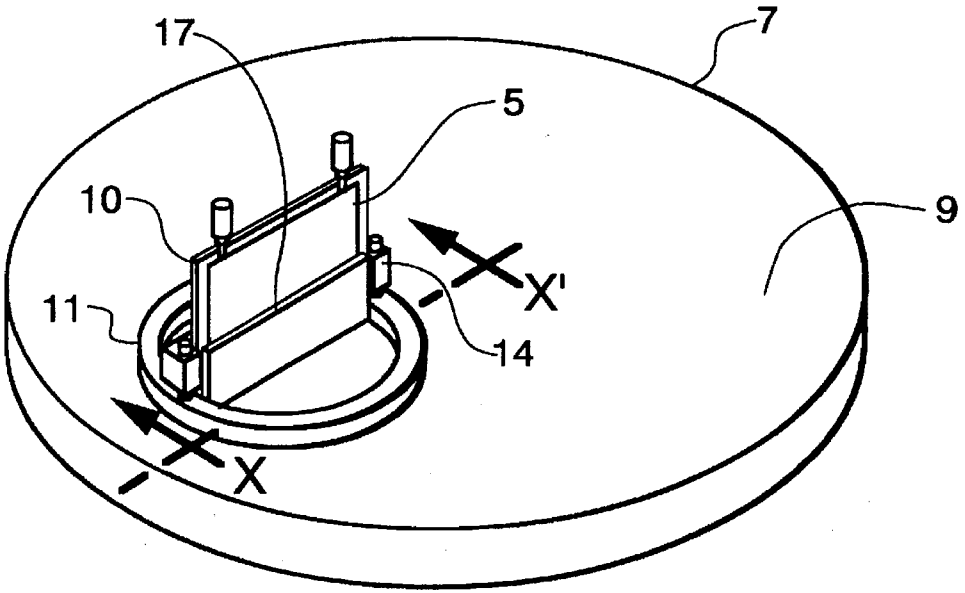
FIG. 1 is an isometric representation of a polishing jig of this invention on a conventional polishing surface.
Figure 2:
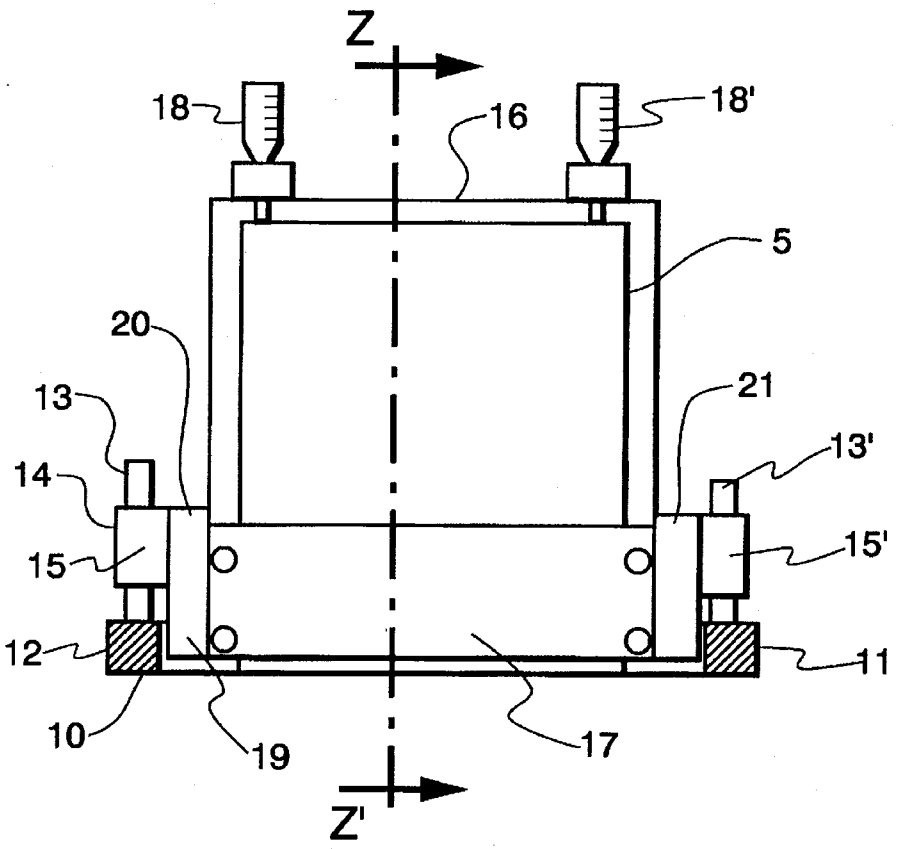
FIG. 2 is a schematic cross-sectional representation of the polishing jig taken along the x—x' section in FIG. 1.
Figure 6:
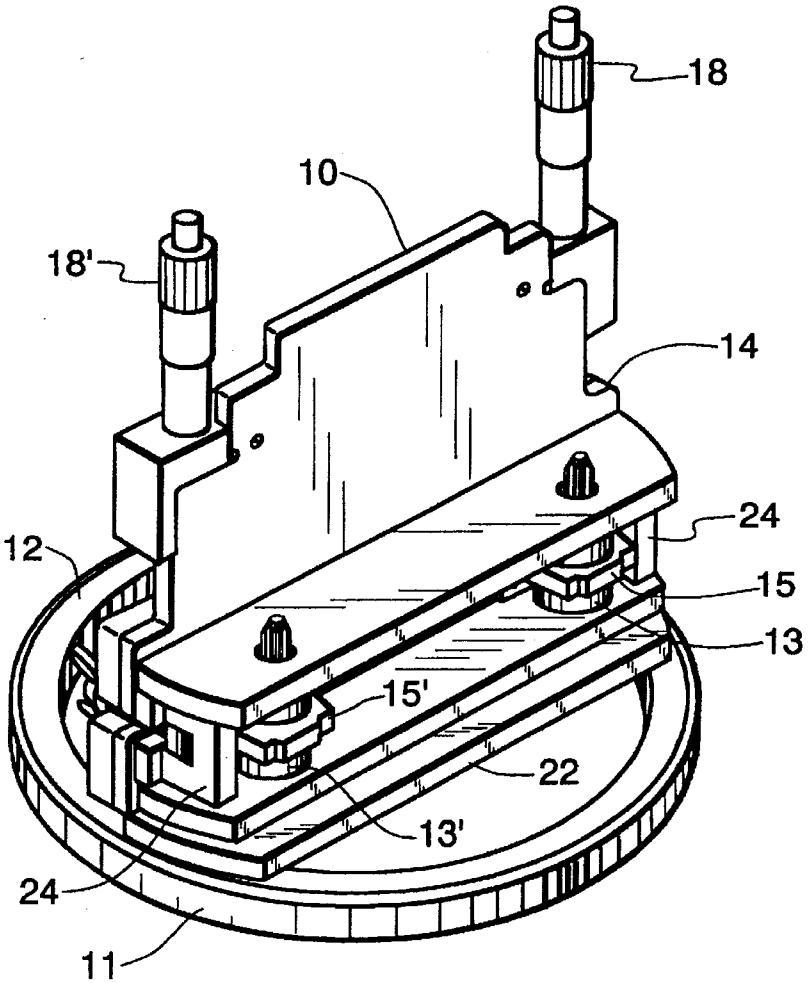
FIG. 6 is an isometric representation of the rear of the polishing jig of FIG. 5.

Referring to FIG. 1, the polishing jig 10 is comprised of a supporting ring guide 11, a panel holder 14, and ,an panel mount 17 for securing the panel 5 onto the panel holder 14. The first component of the polishing jig 10 is the supporting ring guide 11 which rests on a substantially horizontal rotating polishing surface 9 of a conventional polishing wheel 7. Referring to FIG. 2 which is a schematic cross-sectional representation of the polishing jig 10 taken along the x—x' section of FIG. 1, the supporting ring guide 11 comprises a supporting ring 12 which is a metal ring having an outer surface at an outer diameter, an annular surface at an annular diameter, a top surface, and a planar, polished, bottom surface which rests on the polishing surface 9; and two slide guides 13 and 13' extending vertically from the supporting ring 12. The two slide guides are a first 13 and a second 13' slide journal wherein each journal has a journal diameter and a journal axis and wherein each journal is mounted on the supporting ring 12 orthogonal to the polished, bottom surface, with the journal axes defining a journal separation on a cord of the supporting ring 12. The two slide guides 13 and 13' may be mounted directly on the supporting ring 12 or as illustrated in FIG. 6, they may be mounted on a plate or cross member 22 which spans the supporting ring 12 and is mounted thereto. In either instance the components of the mounted slide guides 13 and 13' should be within the outer perimeter the supporting ring 12 to prevent interference with the polishing operation. The annular diameter of the supporting ring 12 must be at least wide enough to accommodate the longest end of the panel, e.g., greater than 10 inches. The remaining dimensions of the supporting ring 12 or slide guides 13 and 13' are not critical provided they have the stability and rigidity for their purpose. For example, a supporting ring guide 11 manufactured from stainless steel may have a supporting ring 12 with an annular diameter of 10 inches, an outer diameter of 12 inches, and a thickness of 1 inch. Likewise stainless steel journal posts 13 and 13' may have a journal diameter of 0.5 inch or greater and have a journal separation on a cord of the supporting ring 12, such as 11 inches or less when the journal posts 13 and 13' are mounted directly on the supporting ring 12.

Figure 3:
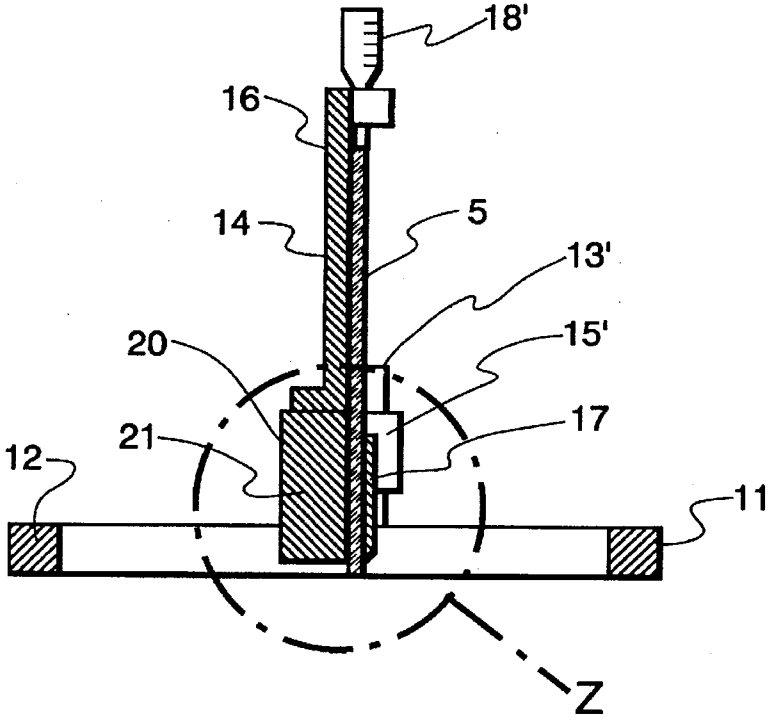
FIG. 3 is a schematic cross-sectional representation of the polishing jig taken along the z—z' section in FIG. 2.
Figure 5:
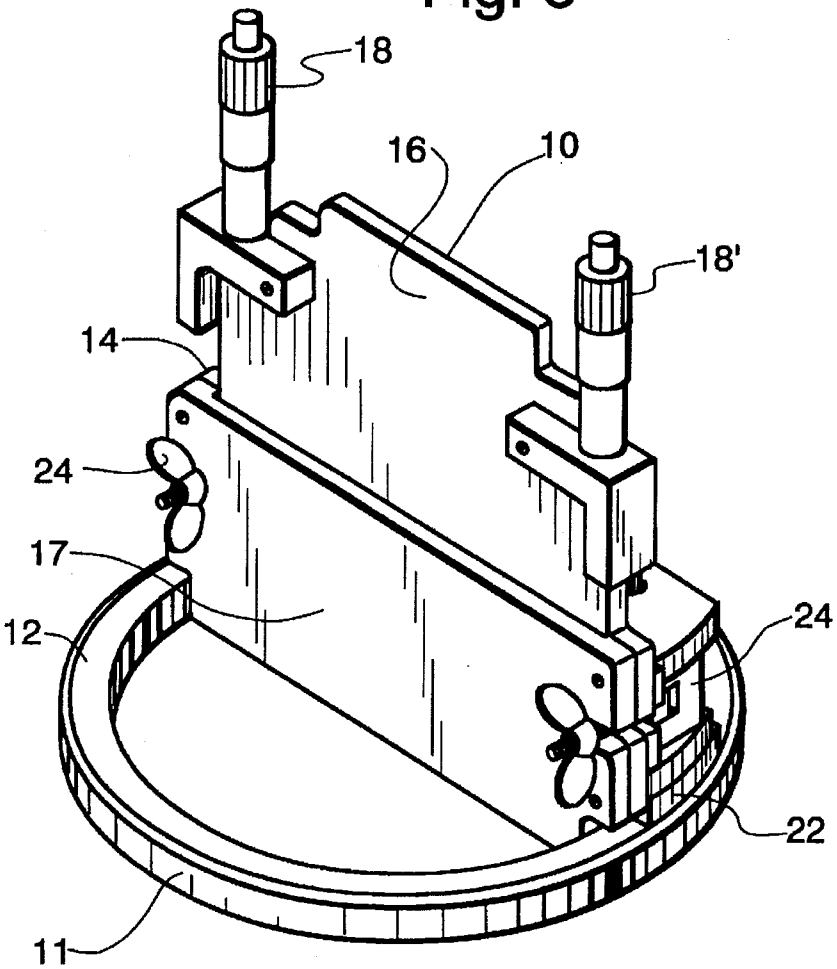
FIG. 5 is an isometric representation of the front of a polishing jig of this invention.

The second component of the polishing jig 10 is a panel holder 14 mounted on the supporting ring and comprising a top and a bottom end 19. The panel holder 14 includes two slide bearings 15 and 15' adapted to accept the two slide guides 13 and 13' mounted on said supporting ring 12, the guides and the slide bearings co-operating to support the panel holder 14 on the ring 12 in a plane substantially perpendicular to the horizontal rotating polishing surface 9 of FIG. 1, and to permit the panel holder 14 to move linearly under gravity in a vertical direction from a first position where the panel holder bottom end 19 is not in contact with the horizontal rotating surface 9 to a second position where the panel holder bottom end 19 is in contact with horizontal rotating surface 9. Although the panel holder 14 may be formed from a single metal piece such as a stainless steel block, it typically is assembled from several individual components which are bolted, fused or otherwise rigidly attached. The panel holder 14 typically comprises a slide mount block 20 having a first slide segment 15, a second slide segment 15' and a mount segment 21; wherein each slide segment has a bottom surface and a slide bearing which is orthogonal to each slide segment bottom surface. Each slide bearing has a cylindrical diameter and a bearing axis, and the slide beatings are parallel having a distance between the bearing axes which is the equivalent to the journal separation on the cord described supra. Each cylindrical diameter of the beatings is sized so that the slide journals cooperate to slide within each respective slide bearing. While the slide beatings may be simple solid metal bearings such as stainless steel, preferably the bearings contain bushings of a softer metal such as bronze, brass or copper. The mount segment 21 has a top surface, a planar mounting surface parallel to a plane containing each bearing axis and a bottom surface orthogonal to the plane containing each bearing axis. Rigidly attached to the slide mount block 20 is a panel mounting plate 16 which has a front plate surface for receiving the panel 5, a top plate end and a bottom plate end. The panel mounting plate 16 and the slide mount block 20 may be assembled in a way that the planar mounting surface of the mount segment 21 is either co-planar with or parallel to the front plate surface of the panel mounting plate 16. When the two surfaces are co-planar, the bottom plate end of the panel mounting plate 16 is rigidly fastened to the top surface of the mount segment 21 in a way that a single planar mounting surface is formed from the two surfaces. In this instance as illustrated in FIGS. 3 and 4, the bottom plate end typically has a lateral extension on the rear surface of the panel mounting plate 16 (i.e., the plate has an "L" shaped cross-section) to facilitate connection to the mount segment 21. Likewise in this instance, the bottom surface of the mount segment 21 is polished and forms the polished bottom end 19 of the panel holder 14. When the two surfaces are parallel, the rear surface of the panel mounting plate 16 is rigidly fastened to the planar mounting surface of the mount segment 21 in a way that the front plate surface of panel mounting plate 16 forms the surface for receiving the panel 5 as illustrated in FIGS. 5 and 6. In this instance, the bottom plate end is polished and forms the polished bottom end 19 of the panel holder 14. Likewise in this instance the bottom plate end of the panel mounting plate 16 may be tapered to form the thin, polished, bottom plate end. In either instance the polished bottom end 19 which has a length which is less than the annular diameter of the supporting ring 12 but greater than the end of the panel 5. In the respective instances, the planar mounting surface of the mount segment 21 or panel mounting plate 16 may have seepage and drain channels in its front surface to prevent wicking of liquid between the panel 5 and the panel holder 14. Typically the panel holder 14 contains two micrometer adjustable panel stops 18 and 18' located near the top plate end to precisely manipulate panel 5. Preferably the panel stops 18 and 18' have a soft metal anvil (e.g., copper, brass, bronze and the like) to engage the panel 5. When the panel holder 14 is mounted on the support ring guide 11, the metal, panel mounting plate 16 typically is orthogonal to the planar, polished, bottom surface of the support ring 12 and when the panel holder 14 is in a fully lowered position on the ring guide 11, the polished bottom end 19 extends below the planar, polished, bottom surface of the supporting ring 12 and is parallel thereto.

The third component of the polishing jig 10 is an panel mount 17 for securing the panel onto the front plate surface of the panel holder 14. The panel mount 17 may be a simple metal plate which spans the panel 5 and is fastened to the mounting plate 16 by conventional means such as bolts, screws, and the like. Referring to FIGS. 3 and 4 which include schematic cross-sectional representations of the panel mount 17 and its relationship to the panel 5 and panel holder 14, the bottom of the panel mount 17 typically is tapered to form the thin, bottom mount edge 22. The mount edge 22 typically is polished when alignment to the plate end 19 is required. Typically the rear surface of the panel mount 17 which abuts panel 5, contains an indented segment to accommodate the panel thickness and obviate compression damage to panel 5. Likewise, a compliant polymeric layer 23 such as polytetrafluoroethylene, is adhered to the rear surface of the panel mount 17 to protect the panel 5 from surface damage by the panel mount rear surface. The panel mount 17 may be a single section 17 or may have a second section 17' which is independently fastened to the mounting plate 16. The panel mount 17 may be fastened directly to the planar mounting surface of the mount segment 21 or to the face of the mounting plate 16 or it may be fastened to other sections of the panel holder 14 such as with the hinged wing-nut assembly 24 illustrated in FIGS. 5 and 6.

Figure 7:
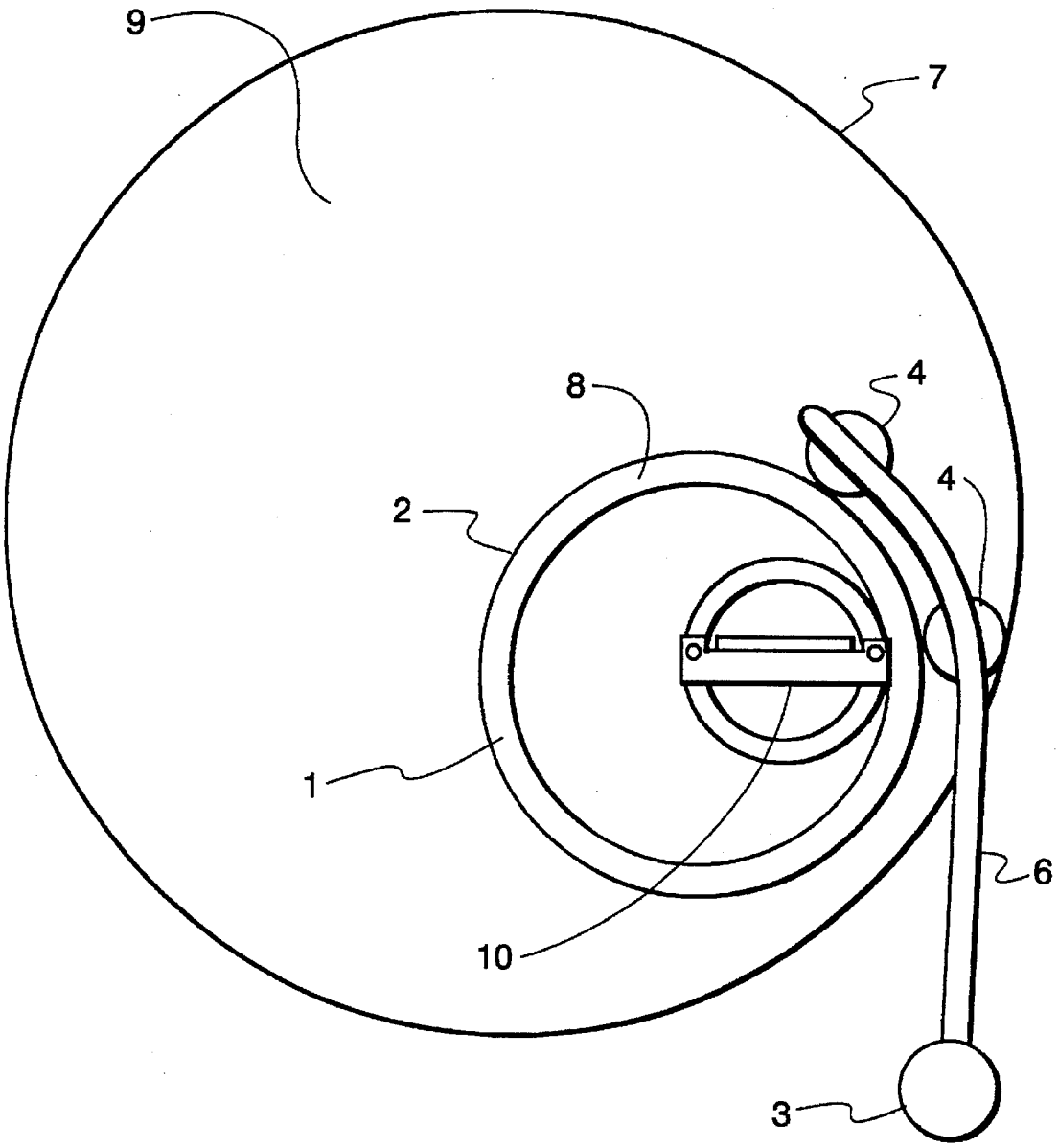
FIG. 7 is a top view representation of a polishing jig of this invention on a conventional polishing system.

A polishing system typically consists of a 36 to 48 inch polishing wheel 7, a conditioning ring, the polishing jig 10 located inside the conditioning ring, and means for holding the conditioning ring in position as the polishing wheel 7 rotates there below. Referring to FIG. 7, the polishing wheel 7 typically is a flat cast iron wheel having a polishing surface 9 (typically consisting of a polyurethane pad) as the top surface. The conditioning ring 1 is a large diameter stainless steel ring which has a polished bottom surface, an outer circumferential surface 2 and an inner circumferential surface 8. The outer diameter typically is 22.5 inches or larger, and the ring cross-section typically is about 1.5 inches high by 1.25 inches wide. The means 6 for holding the conditioning ring 1 in position comprises two or more parallel idler wheels 4 located, over the polishing surface 9 and fixed to stationary base 3 of the rotating polishing wheel 7.

In the process of this invention the panel 5 is mounted onto the panel holder 14; the position of the panel 5 is then adjusted in relation to the pixel array so that the panel 5 extends beyond the panel holder 14 bottom end a specified distance; the panel 5 is secured in position onto panel holder with the panel mount 17; and the polishing jig 10 with the mounted panel 5 is placed onto the horizontal rotating polishing surface 9 and the panel bottom end is polished to remove the protruding portion of the panel bottom end which extends beyond the polished bottom end 19 of the panel holder 14.

The mounting operation will be described with reference to the co-planar orientation of the planar mounting surface of the mount segment 21 with the front plate surface of the panel mounting plate 16 as described supra with reference to FIGS. 3 and 4. During the mounting operation, the panel holder 14 typically is removed from the supporting ring guide 11 and either laid on its back or preferably inverted and held vertically in place so that the adjustable panel stops 18 and 18' are in a lower position. The rear surface of the panel 5 is then laid onto the panel mounting plate 16 of the coplanar mounting surface so that one end engages the adjustable panel stops 18 and 18', e.g., micrometers, and the end to be polished is located just below (e.g., about 10 microns) the polished bottom end 19 of the mount segment 21. In a preferred mounting operation with the panel holder 14 held in an inverted vertical position, the panel bottom end which is substantially parallel to the array, is visually aligned about 10 to 20 microns below the polished bottom end 19. An optical flat is then placed on the polished bottom end 19 of the mount segment 21 so that a portion of the flat overhangs the panel end to be polished. The interference fringe pattern viewed through the optical flat is noted and the panel position adjusted with each of the micrometers 18 and 18' until there is a change in the interference fringe pattern. This alignment operation is further repeated at several locations on the polished bottom end 19 to insure that the end to be polished is juxtaposed the polished bottom end 19. Using a microscopic measuring device (or other suitable measuring means) the distance at two or more locations is measured from the closest pixels in the array to the polished bottom end 19. From these measurements and the specified distance required from the array to the panel polished end, the panel location is adjusted by the adjustable panel stops 18 and 18' so that the required specified distance from the array coincides with the polished bottom end 19. Typically this adjustment is made by dialing in the appropriate distance with calibrated micrometer panel stops 18 and 18' with excess panel end protruding beyond the polished bottom end 19. Either prior to or after the adjustment, the panel 5 is secured onto panel holder 14 with the panel mount 17. Typically the panel 5 is loosely secured prior to adjustment to the extent that transverse movement required for the adjustment is not impeded. In either instance the panel 5 is rigidly secured after adjustment. When a two component panel mount 17 and 17' is used, only the first component 17 is applied prior to adjustment to facilitate measurement, and the second component 17' is applied after adjustment is made. Once the adjusted panel 5 is rigidly secured to the panel holder 14, the two slide bearings 15 and 15' of the panel holder 14 are mated to the respective slide guides 13 and 13' of the supporting ring guide 11. The resulting polishing jig 10 with the mounted panel 5 is then placed inside the conditioning ring 1 onto the horizontal rotating polishing surface 9 so that the polished bottom surface of the supporting ring 12 rests or rides on the polishing surface 9. Although a preferred mounting operation is described supra, it is understood that any equivalent proceedure may be used to align and secure a panel 5 to a panel holder 14 to effect the precise protrusion of excess panel end beyond the polished bottom end 19.

During a typical polishing operation, a liquid polishing agent such as a colloidal silica polishing solution, is applied to the polishing surface 9 of the spinning polishing wheel 7.

The outer circumferential surface 2 of the conditioning ring 1 riding on the polishing surface 9, is driven into contact with the two or more idler wheels 4 to hold the conditioning ring 1 in place over the spinning polishing surface 9. The spinning polishing surface 9 cooperates with the stationary conditioning ring 1 to induce a rotation of the conditioning ring 1 in the rotational direction of the polishing wheel 7 spin. In turn, the supporting ring 12 of the polishing jig 10 riding on the polishing surface 9, is driven into contact with the inner circumferential surface 8 of the conditioning ring 1 and thereby is held in place over the spinning polishing surface 9. The spinning polishing surface 9 and the engagement with the rotating conditioning ring 1 cooperates with the supporting ring 12 to induce a rotation of the polishing jig 10 in the rotational direction of the polishing wheel 7 spin. As the bottom end of the panel 5 is polished, the panel 5 and the panel holder 14 slowly lowers by gravity to maintain contact with the polishing wheel surface 9. When the bottom end has been polished even with the polished bottom end 19 of the panel holder 14 the polishing rate slows significantly and the process is complete.

Those skilled in the art having the benefit of the teachings of the present invention as hereinabove set forth, can effect numerous modifications thereto. These modifications are to be construed as being encompassed within the scope of the present invention as set forth in the appended claims.

What is claimed is:

1. A jig for polishing a end of a panel having a front and a back surface and a top and a bottom end, for use with a polishing apparatus comprising a substantially horizontal routing polishing surface and a supporting ring resting on said rotating surface, wherein:

a) the supporting ring comprises two slide guides extending vertically from said ring;

b) a panel holder mounted on the supporting ring and comprising a top and a bottom, said holder including two slide bearings adapted to accept the two slide guides on said supporting ring, the guides and the slide bearings co-operating to support the panel holder on said ring in a plane substantially perpendicular to the horizontal rotating polishing surface and to permit the panel holder to move linearly under gravity in a vertical direction from a first position where the panel holder bottom end is not in contact with said horizontal rotating surface to a second position where the panel holder bottom end is in contact with said horizontal rotating surface, the panel holder having a planar mounting surface; and c) a panel mount for securing the panel onto the panel holder.

2. The jig according to claim 1 wherein the planar mounting surface is substantially perpendicular to the horizontal rotating polishing surface.

3. The jig according to claim 1 wherein the panel holder bottom end is a polished reference surface.

4. The jig according to claim 1 wherein the panel holder further comprises a micrometer adjustable panel stop located near said panel holder top end.

5. The jig according to claim 1 wherein the slide bearings have bushings therein.

6. The jig according to claim 1 wherein the two slide guides are mounted directly on the supporting ring.

7. The jig according to claim 1 wherein the two slide guides are mounted on a plate which spans the supporting ring and is mounted thereon.

8. The jig according to claim 1 wherein the two slide guides are journal posts.

9. The jig according to claim 1 wherein the panel holder is stainless steel.

10. The jig according to claim 1 wherein the panel comprises a planar dielectric support and an array of a plurality of solid state electronic pixels adjacent the front surface and parallel to at least the bottom end of the panel.

11. A jig for polishing an end of a panel having a from and back surface, and a top and bottom end, and an array of a plurality of solid state electronic pixels adjacent the front surface and parallel to at least the bottom end; and wherein the bottom end of the panel is polished to within a specified distance of the array; the jig comprising a supporting ring guide and mounted thereon a panel holder wherein motion of the panel holder is restricted to a direction orthogonal to the supporting ring guide; wherein:

I. the supporting ring guide comprising:

A. a supporting ring comprising a metal ring having an outer surface at an outer diameter, an annular surface at an annular diameter, a planar, polished, bottom surface, and a top surface;

B. a first and second slide journal wherein each journal has a journal diameter and a journal axis and wherein each journal is mounted on the support ring orthogonal to the polished, bottom surface, with the journal axes defining a journal separation on a cord of the support ring; and II. the panel holder comprising:

C. a slide mount block having a first slide segment, a second slide segment and a mount segment; wherein each slide segment has a bottom surface and a slide bearing which is orthogonal to each slide segment bottom surface, wherein each slide bearing has a cylindrical diameter and a bearing axis, wherein the slide bearings are parallel having a distance between the bearing axes which is the equivalent to the journal separation on the cord, and wherein each cylindrical diameter is sized so that the slide journals slide within each respective slide bearing; and wherein the mount segment has a planar mounting surface parallel to a plane containing each bearing axis and a bottom surface orthogonal to the plane containing each bearing axis;

D. a panel mounting plate which is rigidly attached to the planar mounting surface of the slide mount block, having a front plate surface for receiving the panel which is co-planar with the planar mounting surface of the mount segment or is parallel thereto, a top plate end and a bottom plate end which has a length which is less than the annular diameter;

E. an panel mount for securing the panel onto the front plate surface; and optionally F. micrometer adjustable panel stops located near the top plate end; wherein when the panel holder is mounted on the support ring guide, and when the panel holder is in a fully lowered position on the ring guide, the panel holder has a polished bottom end which extends below the planar, polished, bottom surface of the supporting ring and is parallel thereto.

12. The jig according to claim 11 wherein the polished bottom end of the panel holder is the mount segment, bottom surface of the slide mount block.

13. The jig according to claim 11 wherein the polished bottom end of the panel holder is the bottom plate end of the panel mounting plate.

14. A process for polishing an end of a panel using a jig for use with a polishing apparatus comprising a substantially horizontal rotating polishing surface and a supporting ring resting on said rotating surface, wherein:

a) the supporting ring comprises two slide guides extending vertically from said ring;

b) a panel holder mounted on the supporting ring and comprising a top and a bottom, said holder including two slide bearings adapted to accept the two slide guides on said supporting ring, the guides and the slide bearings co-operating to support the panel holder on said ring in a plane substantially perpendicular to the horizontal rotating polishing surface and to permit the panel holder to move linearly under gravity in a vertical direction from a first position where the panel holder bottom end is not in contact with said horizontal rotating surface to a second position where the panel holder bottom end is in contact with said horizontal rotating surface, the panel holder having a planar mounting surface; and c) an panel mount for securing the panel onto the panel holder; the panel having a front and a back surface, and a top and a bottom end, and an array of a plurality of solid state electronic pixels adjacent the front surface and parallel to at least the bottom end; the process comprising:

I. mounting the back surface of the panel onto the planar mounting surface of the panel holder wherein the bottom end of the panel is juxtaposed to the panel holder bottom end;

II. adjusting the panel on the panel holder to position the array a specified distance from the panel holder bottom end wherein a portion of the bottom end of the panel extends beyond the specified distance and the panel holder bottom end;

III. securing the panel onto panel holder with the panel mount;

IV. placing the polishing jig with the panel mounted thereon onto the horizontal rotating polishing surface and polishing the bottom end to remove the portion of the bottom end which extends beyond the panel holder bottom end.

* * * * *

UNITED STATES PATENT AND TRADEMARK OFFICE

CERTIFICATE OF CORRECTION

PATENT NO. : 5,658,186

DATED : August 19, 1997

INVENTOR(S) : Joseph A. Perrotto, Emil C. Hergenroeder, Jr., and Robert S. Davis

It is certified that error appears in the above-indentified patent and that said Letters Patent is hereby corrected as shown below:

In Claim 1, Column 7, line 31: replace "routing" with – rotating –

In Claim 11, Column 8, line 7: replace "from" with – front –

Signed and Sealed this

Eighteenth Day of November 1997

*Attest:*

Bruce Lehman

BRUCE LEHMAN

*Attesting Officer*

*Commissioner of Patents and Trademarks*